US010988977B2

(12) United States Patent
Schut

(10) Patent No.: US 10,988,977 B2
(45) Date of Patent: Apr. 27, 2021

(54) COLLAPSIBLE SECURITY GRILLE, GRILLE SYSTEM, BAR, AND METHOD

(71) Applicant: Stackdoor B.V., Zeewolde (NL)

(72) Inventor: Tammo Schut, Zeewolde (NL)

(73) Assignee: STACKDOOR B.V., Zeewolde (NL)

( * ) Notice: Subject to any disclaimer, the term of this patent is extended or adjusted under 35 U.S.C. 154(b) by 268 days.

(21) Appl. No.: 16/071,700

(22) PCT Filed: Jan. 20, 2017

(86) PCT No.: PCT/NL2017/050039
§ 371 (c)(1),
(2) Date: Jul. 20, 2018

(87) PCT Pub. No.: WO2017/126968
PCT Pub. Date: Jul. 27, 2017

(65) Prior Publication Data

US 2019/0390510 A1 Dec. 26, 2019

(30) Foreign Application Priority Data

Jan. 21, 2016 (NL) ..... 2016133

(51) Int. Cl.
*E06B 9/06* (2006.01)

(52) U.S. Cl.
CPC ..... *E06B 9/063* (2013.01); *E06B 9/0653* (2013.01)

(58) Field of Classification Search
CPC ..... E06B 9/0623; E06B 9/0676; E06B 9/18; E06B 9/063; E06B 9/0653; E06B 9/0646; E06B 9/0607; E06B 9/0615; E06B 9/06
See application file for complete search history.

(56) References Cited

U.S. PATENT DOCUMENTS 1,612,771 A 12/1926 Pfeiffer
1,954,464 A * 4/1934 Violette ..... E06B 9/0638 160/172 R (Continued)

FOREIGN PATENT DOCUMENTS

DE 435814 C * 3/1927 ..... E06B 9/0653
DE 475386 C 4/1929

(Continued)

OTHER PUBLICATIONS

International Search Report PCT/NL2017/050039 dated Jun. 8, 2017.

(Continued)

*Primary Examiner* — Johnnie A. Shablack
(74) *Attorney, Agent, or Firm* — Pillsbury Winthrop Shaw Pittman, LLP

(57) ABSTRACT

The invention relates to a collapsible security grille. The grille comprises a multiplicity of successive bars that can be substantially stacked in a retracted state of the grille and can be substantially spaced apart with respect to each other in an extended state of the grille. At least a number of the bars comprises one or multiple parts formed from bent sheet metal. Advantageously, each of at least a number of the bars can be put together from at least a first part formed from a first blank of sheet metal and a second part formed from a second blank of sheet metal. In particular, at least the first part can be a bent profile. Additionally or alternatively, at least the second part can be a bent profile.

5 Claims, 5 Drawing Sheets

(56) References Cited

U.S. PATENT DOCUMENTS 2,091,012 A * 8/1937 Pratt ..... E06B 9/386 160/232
2,369,493 A * 2/1945 Rood ..... E06B 9/063 160/167 R
2,422,840 A * 6/1947 Mayer ..... E06B 9/01 160/34
2,672,192 A * 3/1954 Goldner ..... E06B 9/0676 160/32
2,940,520 A * 6/1960 Cookson, Jr. ..... E06B 9/18 160/229.1
3,280,888 A 10/1966 Wilbur
3,297,076 A * 1/1967 Udin ..... E06B 9/0661 160/161
3,358,741 A * 12/1967 Udin ..... E06B 9/0623 160/161
3,506,056 A * 4/1970 Quinones ..... E06B 9/0661 160/160
3,601,175 A * 8/1971 Wardlaw ..... E06B 9/18 160/213
3,850,465 A 11/1974 Hill
4,035,008 A 7/1977 Hardt
4,139,042 A 2/1979 Watanabe
4,397,347 A * 8/1983 Brabant ..... E06B 9/0638 160/231.2
4,493,356 A 1/1985 Hermann
4,573,512 A 3/1986 Lichy
4,595,043 A 6/1986 Nozawa
4,694,531 A * 9/1987 Foy ..... A47H 1/144 104/111
4,836,331 A 6/1989 Kasai
4,984,387 A 1/1991 Wheatland
5,316,065 A * 5/1994 Alligood ..... E06B 9/0638 160/170
5,655,589 A * 8/1997 Vartanian ..... E06B 9/386 160/166.1
5,957,181 A 9/1999 Cohen-Ravid
6,035,917 A 3/2000 Cohen-Ravid
6,640,871 B2 11/2003 Cohen-Ravid
6,651,724 B1 11/2003 Cittadini
6,742,563 B2 6/2004 Belanger
7,152,655 B2 12/2006 Clauss
8,534,343 B2 * 9/2013 Yl ..... E06B 9/0661 160/102
9,540,838 B2 * 1/2017 Black ..... E04H 5/06
9,540,866 B2 * 1/2017 Yi ..... E05C 9/02
10,180,028 B2 * 1/2019 Schut ..... E06B 9/0623
2002/0036068 A1 * 3/2002 Cohen-Ravid ..... E06B 9/18 160/188
2016/0129434 A1 * 5/2016 Pokoo-Aikins ..... B01J 35/004 502/2
2019/0390510 A1 * 12/2019 Schut ..... E06B 9/0653

FOREIGN PATENT DOCUMENTS

EP 1036911 A2 9/2000
EP 2058469 A2 * 5/2009 ..... E06B 7/082
GB 2014226 A 8/1979
GB 2250582 A * 6/1992 ..... E06B 7/082
NL 21495 4/1930
WO 98/42942 A1 10/1998
WO 01/69029 A1 9/2001
WO 2015/115893 A1 8/2015

OTHER PUBLICATIONS

Office Action issued in EP Application No. 15 711 590.8 dated May 3, 2018.
Dutch Search Report dated Aug. 4, 2014 for Appln. No. 1040647.
Computer Translation of AT 107448 dated Oct. 10, 1927 publication corresponding to NL 21495.
International Search Report for PCT/NL2015/050055 dated Jun. 3, 2015.
International Preliminary Report on Patentability dated Jul. 24, 2018 issued in corresponding International Patent Application No. PCT/NL2017/050039.

* cited by examiner

COLLAPSIBLE SECURITY GRILLE, GRILLE SYSTEM, BAR, AND METHOD

CROSS-REFERENCE TO RELATED APPLICATIONS

This is the U.S. National Stage of PCT/NL2017/050039, filed Jan. 20, 2017, which in turn claims priority to: Netherlands Application No. 2016133, filed Jan. 21, 2016, the contents of each of these applications being incorporated herein by reference in their entireties.

The invention relates to collapsible security grilles and to security grille systems with such collapsible security grille. Said collapsible security grilles can be for securing a passage such as a doorway or window at least partly. For example, the security grille may be to screen off and/or protect for instance shops, business establishments, warehouses, kitchens, schools, parking garages, etc. and/or for partitioning spaces, for instance in a shopping center or an airport terminal building.

Collapsible security grilles are for instance known from European patent publication EP 1 036 911 A2 and from applicant's international patent application publication WO 2015 115 893 A1.

Said publications disclose stackable security grilles comprising a multiplicity of successive bars that can be substantially stacked in a retracted state of the grille and can be substantially spaced apart with respect to each other in an extended state of the grille. For instance, said bars can extend substantially horizontally, and may at outer ends be guided within a guide profile or guide bar. The bars may be provided with series of corresponding through holes or passages for allowing elongated connecting elements, such as rods, to pass through at least a number of the bars. Such connecting element, preferably its upper end or lower end, can be fixedly connected to a respective one of the bars. The opposite end of the connecting element may be provided with a retainer element, in particular a thickening or lateral protruding portion such as a so-called head. The passage in the bar adjacent to the bar to which the connecting element is fixated can be wide enough to allow a shaft of the connecting element to pass, but can be narrow enough to block the retainer element of the connecting element from passing there through. One or multiple subsequent bars can have corresponding holes, preferably though holes, that are wide enough to allow the retainer element to pass through there and/or to be accommodated therein at least partly when the security grille is collapsed.

In known collapsible, especially stackable, security grilles, the bars are made from metal tubes or pipes having a substantially square or substantially rectangular cross-section. After providing said tube or pipe, an upper wall of the hollow tube or pipe is being provided with a first hole pattern and a lower wall of the hollow is being provided with a second hole pattern corresponding to the first hole pattern. Said hole patterns are usually laser cut into the respective tube wall. In the security grille of WO 2015 115 893 A1, a passage in the bar used for blocking the retainer element can be formed by a relatively narrow first hole in a first tube wall, e.g. the upper wall, for blocking the retainer element and a corresponding relatively wide second hole in a second tube wall, e.g. the bottom wall, which can allow the retainer element to enter the tube or bar such as to be kept out of sight substantially in the extended state of the security grille.

Alternatively, as seems to be shown in the figures of publication EP 1 036 911 A2, all holes may have a substantially equal diameter and the passages that are mentioned to block the retainer element, or so-called heads, can be provided by a bush or bushing that narrows the passage formed by two corresponding through holes in opposite wall sections of the tube forming the bar.

Laser cutting the holes in walls or wall section of the tubes can be difficult, time-consuming, expensive, painstaking and/or error-prone.

An object of the present disclosure is to provide an alternative collapsible, in particular stackable, security grille, and/or an alternative method for manufacturing a collapsible security grille. It is an object of the present disclosure to alleviate or solve at least one disadvantage of one or more known stackable security grilles. In particular, it can be considered an object of the disclosure to alleviate or solve at least one disadvantage mentioned above. More in particular, the invention may aim to provide a collapsible security grille which can be produced in a manner that is relatively cost efficient, relatively little prone to errors, relatively easily, and/or relatively fast. In embodiments, the invention aims at providing a collapsible, especially stackable, security grille without laser cutting holes in walls or wall sections of pipes or tubes for forming bars of the grille.

Thereto, in a first aspect, the disclosure provides for a collapsible security grille that comprises a multiplicity of successive bars that can be substantially stacked in a retracted state of the grille and can be substantially spaced apart with respect to each other in an extended state of the grille, wherein at least a number of the bars comprises one or multiple parts formed from bent sheet metal. By making one or multiple bar parts from bent sheet metal, especially formed from a respective blank of sheet metal, holes in opposite walls or wall sections of the final bar can in embodiments be formed before a substantially hollow bar is formed from said one or more bar parts from bent sheet metal. This may for instance allow that holes can be punched, e.g. while or after a blank is formed for forming the bar or a respective part of the bar. In stead of laser cutting holes in respective walls or wall sections of a purchased pipe, holes may thus be formed in a relatively cost efficient, relatively easy, and/or relatively foolproof manner.

For example, a first bar part can be formed which comprises a wall or wall section for forming an upper wall or upper wall section of the final bar. Said first wall section or wall can then be provided with holes, which holes will later form the holes in said upper wall section or upper wall of the final bar. Said holes made in said first wall or first wall section can be made without any second wall or second wall section for forming a lower wall or lower wall section of the final bar hindering that said holes are made in said first wall or first wall section, because a second bar part comprising said second wall or second wall section can be absent. Advantageously, the holes in the first wall or first wall section can be made in a first blank, before said first blank is bent in order to deform it into the first bar part. Additionally or alternatively, holes in the second wall or second wall section can be made in a second blank before said second blank is bent in order to deform it into the second bar part.

As another example, the first pattern of holes in the first wall or first wall section of the final bar and the second pattern holes in the second wall or second wall section of the final bar may be formed in a single blank and said single blank may subsequently be bent into a bar or into a bar part, especially in a manner that the holes of the first and second pattern pair up into pairs of corresponding holes for forming passages through the final bar.

In preferred embodiments, each of at least a number of the bars can thus be put together from at least a first part formed from a first blank of sheet metal and a second part formed from a second blank of sheet metal. At least the first part and/or at least the second part may then be formed as a bent profile. By composing a bar from multiple bar parts, wherein one can be slit into another one, a second bar part extending at least partly within another, e.g. first, bar part, can extend from said first bar part in order to couple two first bar parts together. This is, a second bar part may thus overlay with two first bar parts that are placed in line and succeed each other in their longitudinal direction. The second or inner bar part can then counteract that the consecutive first or outer bar parts can be moved with respect to each other in a direction substantially transverse to their longitudinal directions. As a result, relatively long bars can be composed in a relatively easy manner, which may facilitate forming relatively wide grilles that are relatively strong in a relatively simple and/or cost efficient manner.

It is noted that, in advantageous cases in which the bar is built up from at least multiple parts, neither the first bar part nor the second bar part does need to be a bent part. For instance, the first bar part does not need to be a bent part. Additionally or alternatively, the second bar part does not need to be a bent part. For example, the first bar part can be bent part forming a profile provided with a first hole pattern and holding a second part, which can be provided with the second hole patter, wherein said second bar part may for instance be formed from an unbent piece of sheet metal. As another example, the first and second bar parts can be formed as unbent parts, preferably each provided with a respective hole pattern, and one or more further bar parts, e.g. parts forming side walls of the bar, can be formed as bent parts holding the first and second parts in place.

Advantageously, the first part can be at least partly enclosing the second part. The first part may then define a hollow room for accommodating the second part at least partly in an assembled state of the bar.

In embodiments, a bar part, especially the first bar part, may comprise one or multiple supports or retaining elements. Said one or more supports or retaining elements may be for supporting a further bar part, especially the second part. Additionally or alternatively, said one or more supports may be for facilitating retaining said further bar part at least partly within the bar part provided with said one or more retaining elements or supports.

Advantageously, the two bar parts can both be bent such as to have a substantially C-shaped or U-shaped cross-section. For example, the first bar part can be formed such as to have a cross-section substantially shaped as an inverted U, having inwardly extending supports at the ends of its "legs" or strokes. The second bar part, which then for instance can be formed such as to have a U-shaped cross section, can then be positioned at least partly into a hollow space within the first part. For instance in such embodiments, the bar can have side walls or side wall sections that comprise multiple layers, e.g. two layers, whereas the bottom and upper walls or wall sections may then comprise less layers than the side walls or walls sections. In particular, the top and/or the bottom of the bar may comprise a single layer.

In embodiments, the first part and the second part can move with respect to each other to some extent. In such embodiments, the first part and the second part do thus not need to be fixedly attached to each other. For example, the second part can be moved with respect to the first bar part to at least a small extent in at least a direction substantially parallel with the longitudinal direction of the bar.

The present disclosure also relates to a method for producing a bar for a collapsible security grille and/or for producing a collapsible security grille. The method can comprise the steps of providing a first bar part from sheet metal, providing a second bar part from sheet metal, and assembling a bar from at least said first bar part and said second bar part. Preferably, the bar can be assembled at least partly by sliding the second bar part at least partly into the first bar part, especially in the longitudinal direction of the first bar part. Alternatively or additionally, the bar may be assembled at least partly by forming, e.g. folding or bending, a part at least partly around another part.

The bar parts may be prevented from sliding out of each other by means of one or more connecting elements extending through a first through hole in the first bar part and a corresponding through hole in the second bar part. Additionally or alternatively, the bar parts may be prevented from sliding out of each other by means of guiding means, e.g. guiding profiles which may limit movement of the bar and/or parts thereof in its/their longitudinal direction.

Further, the present disclosure also relates to a security grille system, and to a bar for a collapsible security grille.

Advantageous embodiments of the disclosure are described below and in the appended claims.

By way of non-limiting examples only, embodiments of the present disclosure will now be described with reference to the accompanying figures in which.

The embodiments disclosed herein are shown as examples only and should by no means be understood as limiting the scope of the invention or the disclosure in any way. In this description the same or similar elements have the same or similar reference signs.

Figure 1B:
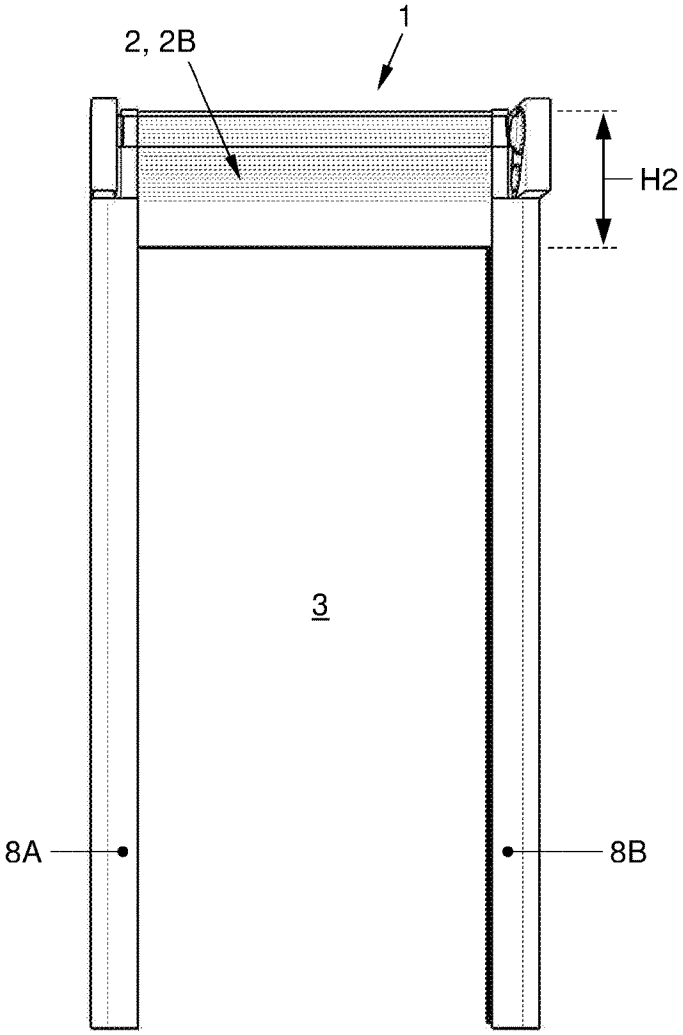
FIG. 1B shows a schematic view of the security grille system of FIG. 1A having its grille in its collapsed state.
Figure 1A:
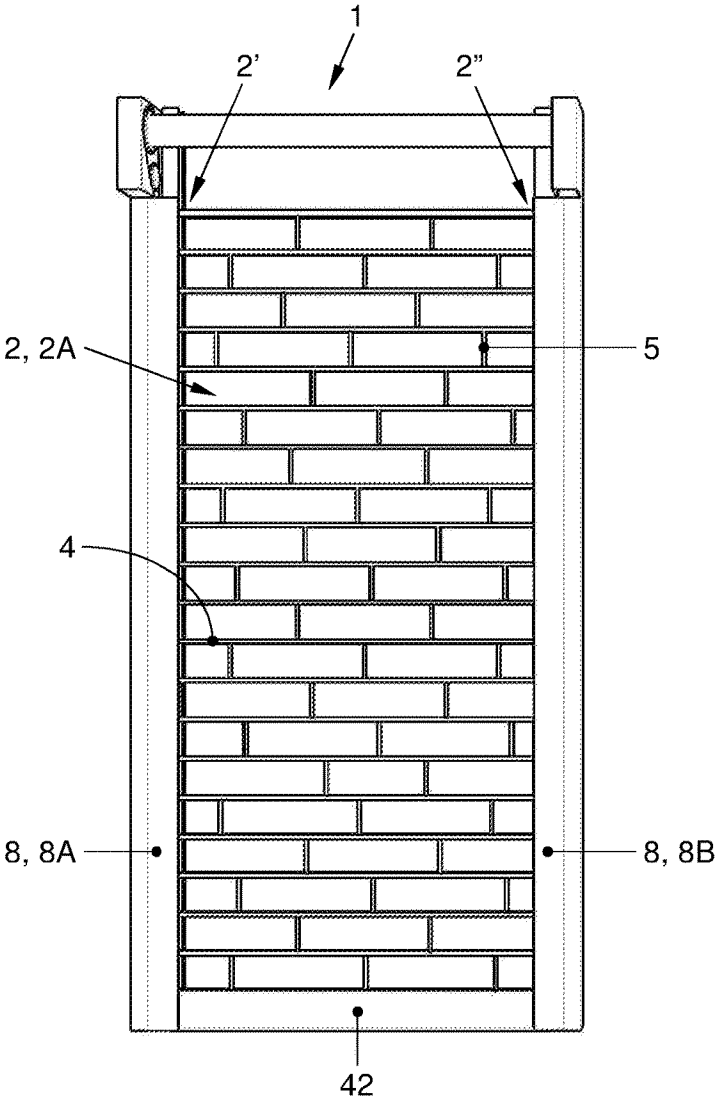
FIG. 1A shows a schematic view of an embodiment of a collapsible security grille system having a grille situated in its extended state.

FIGS. 1A and 1B show a first embodiment of a collapsible security grille system 1 having a collapsible security grille 2 situated in its extended state 2A and its collapsed or so-called retracted state 2B, respectively. It is noted that the collapsible security grille 2 can be a stackable security grille. The stackable and/or collapsible security grille 2 may be suitable for securing a passage 3 at least partly, and can be arranged to be brought from an extended state 2A, in which the grille 2 can block the passage 3 at least partly, into a retracted state 2B, in which at least a part of the previously blocked part of the passage 3 is unblocked.

Although the passage 3, which can be formed as a door opening, in the embodiment shown in FIGS. 1A and 1B has a width which is smaller than its height, the collapsible security grille 2 and/or a security grille system 1 having the collapsible security grille 2 may in alternative embodiments have a relatively large width, preferably a width being larger than the height of the grille in extended state 2A.

Figure 2A:
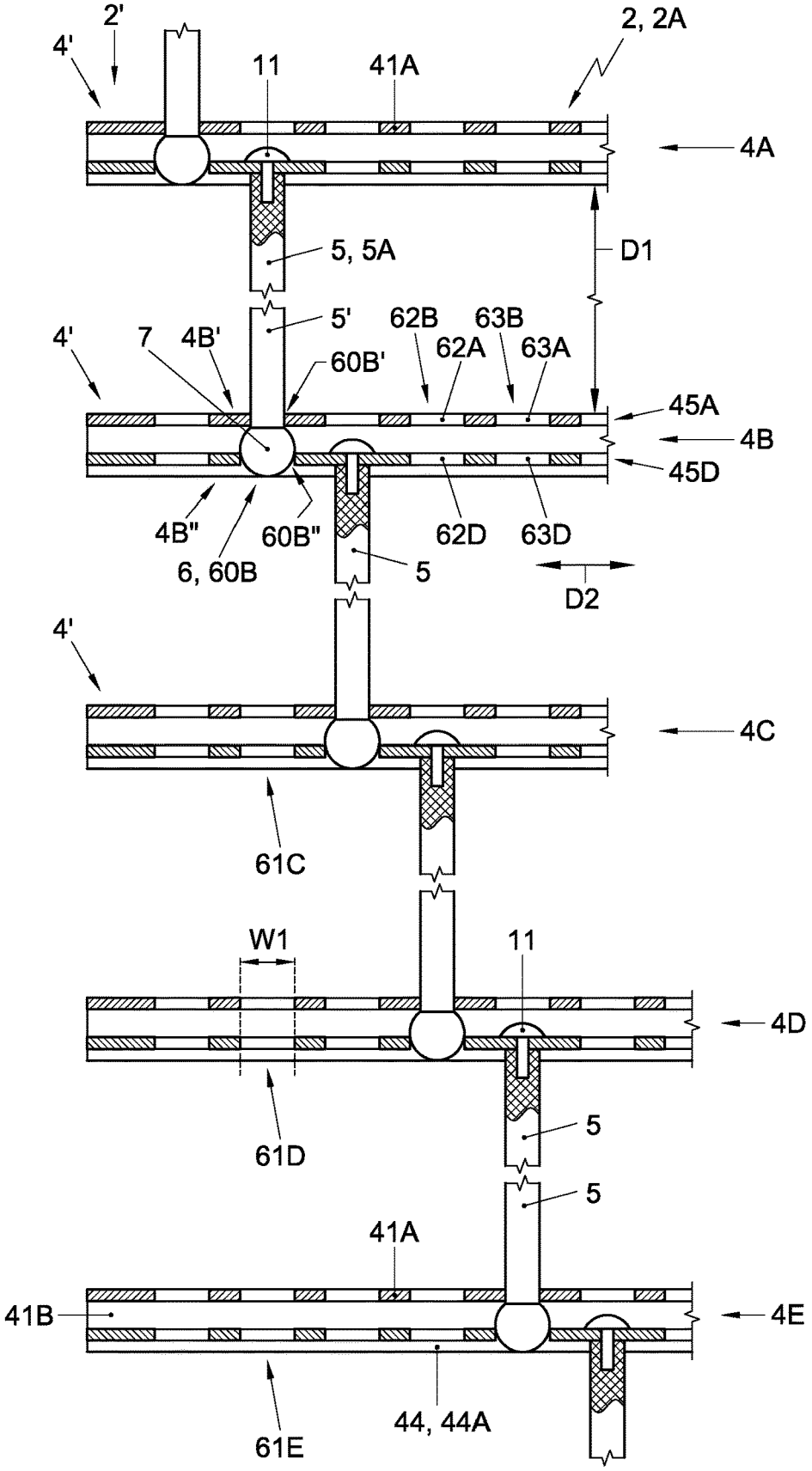
FIG. 2A shows a schematic partly cut-away front view of a portion of an embodiment of a security grille according to an aspect of the present disclosure in its extended state.
Figure 2B:
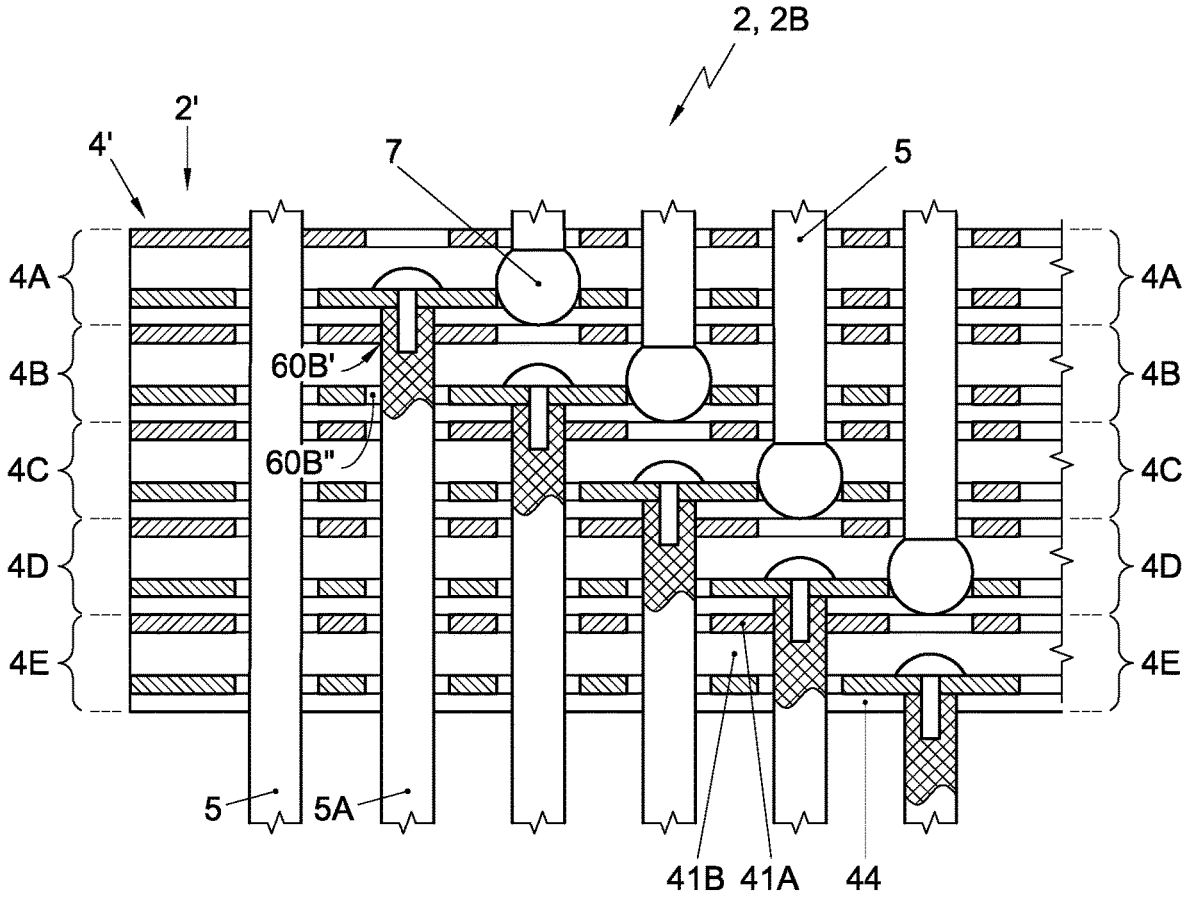
FIG. 2B shows a schematic partly cut-away front view of the portion of the grille of FIG. 2A in its retracted state.

As can be seen in FIGS. 1A and 1B, as well as in FIGS. 2A and 2B which show schematic views of a portion of a second embodiment of the security grille 2 in its extended state 2A and its retracted state 2B, the collapsible security grille 2 comprises a multiplicity of successive bars 4. As can be seen in FIGS. 1B and 2B, the bars 4 can be substantially stacked in a retracted state of the grille 2. Although the grille 2 can be retracted upwardly, as in the shown embodiments, the grille 2 may be retractable downwardly in other embodiments. For example, the stack of stacked bars 4 may then be accommodated within a cavity in the ground or floor, which cavity can then thus be located below the passage 3. As can be seen in FIGS. 1A and 2A, the bars 4 can be substantially spaced apart with respect to each other in the extended state 2A of the grille 2.

It is noted that the bars 4 can preferably extend substantially parallel to each other and/or that the bars 4 may preferably be substantially horizontally extending beams 4. However, in alternative embodiments, the bars 4 may extend in a different direction. For example, the bars 4 can extend substantially vertically and the grille 2 may be retractable in a sideward direction.

In embodiments, the bars 4 can be connected by means of multiple elongated connecting elements 5 for interconnecting respective bars 4. Said connecting elements 5 can substantially be formed as and/or may comprise a pin or peg. Although said connecting elements 5 may extend substantially transverse to the longitudinal direction of the bars 4 and/or substantially vertically, said connection elements 5 may extend in a different direction in alternative embodiments. For example, the connecting elements 5 may in alternative embodiments extend substantially horizontally.

At least a number of the multiplicity of elongated connecting elements 5 may each be arranged for interconnecting two respective spaced apart bars in the extended state of the security grille 2 in such a manner that the respective connecting element 5 counteracts that a first one 4A and a second one 4B of said two spaced apart bars 4A, 4B can be moved apart substantially further with respect to each other.

Thereto, said respective connecting element 5, 5A can be attached to the first bar 4A. Advantageously, a distal end of the connecting element 5 can be attached to the bar 4. Said distal end may preferably be an upper end of the connecting element 5 in case of an upwardly extending connecting element 5. For example, the connecting element 5 may be riveted to the bar or a respective bar part 42, e.g. by means of a blind rivet. However, alternatively or additionally, the connecting element may be connected by other means, e.g. by means of bolting, screwing 11, welding, etc.

Additionally, said respective connecting element 5, 5A can be provided with retainer element 7, e.g. a thickening 7 or lateral protruding portion 7, for limiting the distance D1 over which the first and second bars 4A, 4B can be spaced apart in the extended state 2A of the security grille 2. Said retainer element 7, which may be considered a retainer head 7, can preferably be located at a distal end of the connecting element 5, more preferably, in case of upwardly extending connecting elements, its lower end.

Said second bar 4B can have a passage 6, 60B for allowing the second bar 4B to be moved along a part, e.g. a shaft 5', of the elongated connecting element 5, wherein said passage 60B is arranged to block the retainer element 7 from passing there through. For example, at one point, e.g. at or near an upper end or side 4B' of the bar 4, 4B, the passage 6, 60B may be narrower or tighter than and at another point, e.g. at or near a lower end or side 4B" of the bar 4, 4B. Preferably, as in the shown embodiment of FIGS. 2A and 2B, the passage 6, 60B may be smaller at a side 4B' of the second bar 4B facing towards the first bar 4A than at the opposite, second side 4B" of the second bar 4B, which second side 4B" is facing away from the first bar 4A and is facing to a third bar 4C. As a result, when the grille 2 is being extended and the connecting element 5 is moving through said passage 6, 60B in the second bar 4B, the retainer element 7 of said connecting element 5, 5A can enter into the second bar 4B via a relative wide part 60B" of said passage 60B and can subsequently be stopped by a relative small part 60B' of said passage 60B which then can counteract that the first bar 4A and the second bar 4B can be moved further apart from each other.

In advantageous embodiments in which the respective passage 6, 60B in the second bar 4B is narrowing in a direction towards the first bar 4A, it can be facilitated that the respective retainer element 7 can be accommodated at least partly within the second bar 4B in the extended state 2A of the security grille 2. For example, the narrowing passage 6, 60B in the second bar 4B can be formed by a first through hole 60B' provided in a first wall section 45A of said second bar 4B and second through hole 60B" provided in a second wall section 45B of said bar 4B located opposite said first wall section 45A. Said first wall section 45A of the second bar 4B may then be facing the first bar 4A, while the second wall section 45B of the second bar 4B may be facing a third bar 4C located at the opposite side of the second bar 4B as the first bar 4A.

It is noted that the third bar 4C, and preferably one or more further subsequent bars 4D, 4E, are provided with corresponding passages 61C, 61D, 61E for allowing the connecting element 5, 5A and its retaining element 7 to enter said passages 61C, 61D, 61E and preferably to pass through said passage 61C, 61D, 61E in order to enter one or more following bars 4C, 4D, 4E. Hence, the connecting element 5, 5A can extend through multiple subsequent bars 4B, 4C, 4D, 4E in the so-called retracted, packed, stacked, compacted or collapsed state 2B of the grille 2, as can be seen in FIG. 2B. It will be appreciated that said corresponding passages 61C, 61D, 61E in the third and further bars 4C, 4D, 4E through which said retaining element 7 has to pass during the collapsing of the grille 2 has to be wide W1 enough to allow the retaining element 7 to pass and should thus be wider than smallest part 60B' of the corresponding passage 60B in the second bar 4B which is arranged to block said retainer element 7 from passing there through.

In preferred embodiments, the collapsible and/or stackable security grille 2 can be part of a security grille system 1 arranged for stacking the bars 4 in the retracted state 2B and for subsequently bringing the bars 4, or at least a part of the bars 4, back to the extended state 2A of the grille 2.

Figure 4:
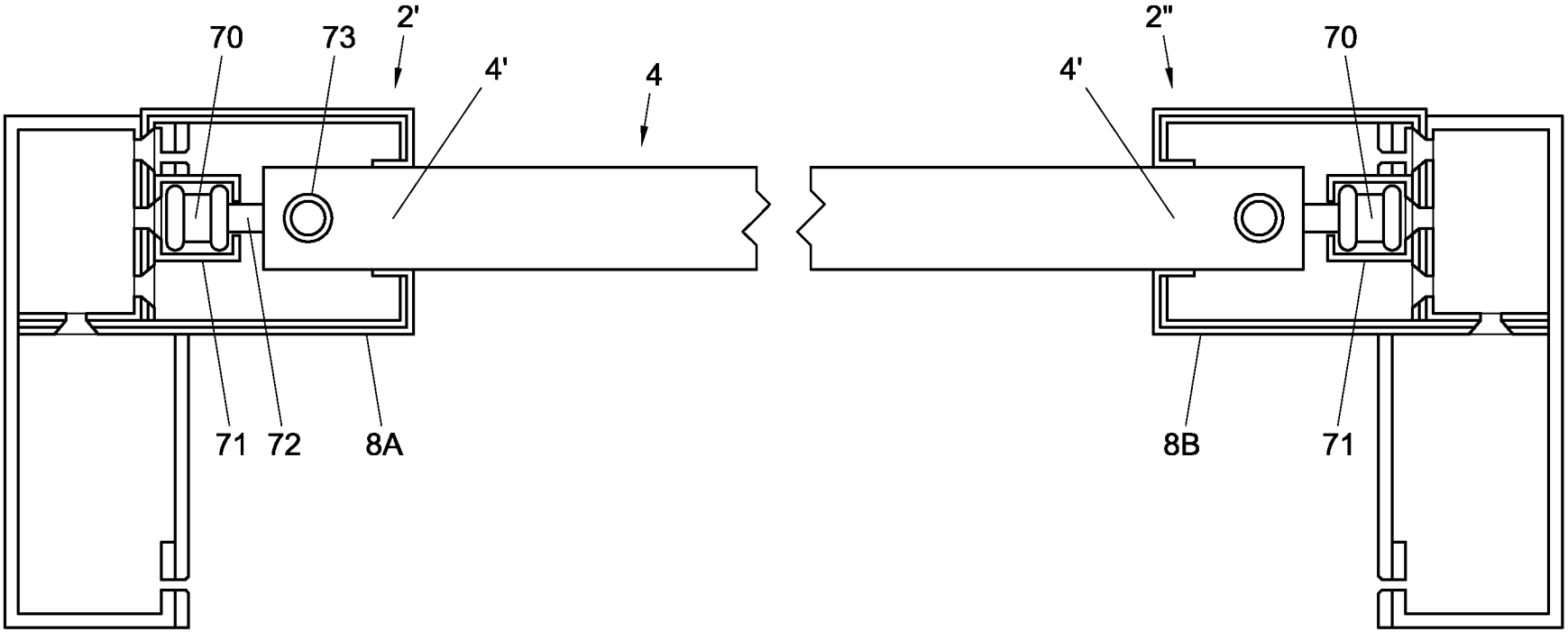
FIG. 4 shows a schematic partly cut-away cross-sectional top view a further embodiment of a collapsible security grille system.

As can be seen in FIGS. 1A and 1B, as well as in FIG. 4, which shows a schematic partly cut-away cross-sectional top view a further embodiment of a collapsible security grille system 1, the grille system 1 may for instance comprise at least one bar guide 8, e.g. a guiding profile 8, for guiding the bars 4 when moving from the retracted state 2B toward the extended state 2A or vice versa and/or for counteracting that the bars 4, or at least respective parts thereof, can be moved in a transverse direction substantially transverse to the direction D2 in which the bars 4 extend and substantially transverse to the direction D1 in which the bars 4 are substantially spaced apart in the extended state 2A. For example, at both lateral ends 2', 2" of the grille 2, a respective bar guide 8A, 8B may be provided for guiding end portions 4', 4" of the bars 4.

Additionally or alternatively, the grille system 1 may comprise an actuator, e.g. a motor, such as an electromotor, for driving the grille, e.g. from its retracted or stacked state 2B to its extended state 2A or vice versa.

The grille system 1 may comprise a moving member, preferably a lifting member, such as a cable or chain, for moving, e.g. lifting, at least a part of the bars 4.

In advantageous embodiments, such as for instance in the embodiment shown in FIG. 4, the security grille system 1 may further comprise a chain 70 connected to the grille 2, preferably a chain 70 being flexible in only one dimension and/or being roller chain 70, and at least one chain limiting member 71 for at least locally limiting movement of the chain, e.g. in a direction in which it is flexible, such as to counteract that one or more links of the chain can be substantially moved away from a regular route along which the links move when the grille 2 is moved from its extended state 2A to its retracted state 2B or vice versa. For example, the chain 70 may be attached to a bottom one 4Z of the bars 4, e.g. by means of a connector 72, such as a bolt or the like. Said bottom one 4Z of the bars may have a relatively large height compared to the other bars 4 in order to accommodate respective connecting elements 5 therein in the retracted state 2B of the grille 2. The chain limiting member 71 can preferably be formed by means of a limiting profile 71, which may for instance be located within and/or parallel with a respective bar guide 8 or bar guiding profile 8.

Figure 3A:
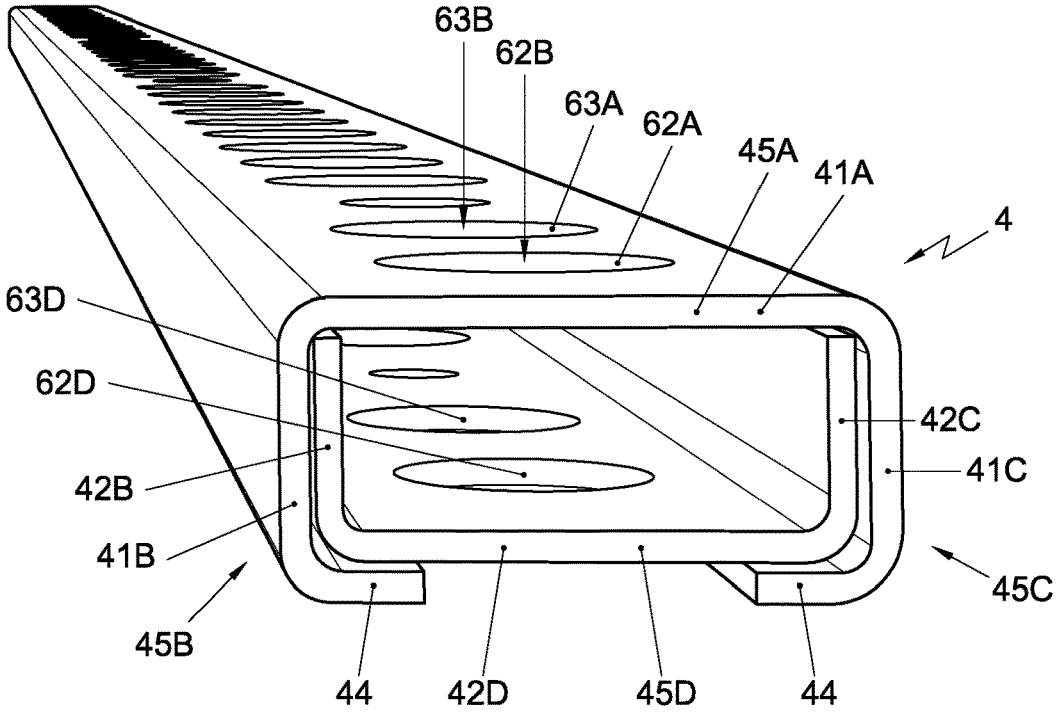
FIG. 3A shows a schematic perspective view of an embodiment of a bar for a security grille according to an aspect of the disclosure.

FIG. 3A shows a schematic perspective view of an embodiment of a bar 4 for a collapsible security grille 2 according to an aspect of the disclosure. Advantageously, the bar 4 may be a substantially hollow bar.

The substantially hollow bar 4, 4B can have a first wall section 45A which during use faces towards an adjacent bar 4A preceding said substantially hollow bar 4B and a second wall section 45D facing towards a subsequent bar 4C succeeding said substantially hollow bar 4B. The first wall section 45A can be provided with a number of first holes 62A, 63A, and the second wall section 45D can be provided with a number of corresponding second holes 62D, 63D. Respective ones 62D, 63D of the second holes can then form pairs 62B, 63B with a respective one 62A, 63A of the first holes. Such pair of holes 62B, 62D; 63B, 63D, for instance together with a certain portion of a hollow room 43 within the bar 4, may then thus form a passage 6 through the bar 4. Said pair of holes and/or said passage can allow a respective one of the connecting elements 5 to extend there through.

Additionally to the first wall section 45A and the second wall section 45D, the substantially hollow bar 4 can have at least two sections 45B, 45C defining side walls of the bar 4. Each of said two side wall defining sections 45B, 45C can extend from the first wall section 45A towards the second wall section 45D or vice versa. It is noted that the elongated connecting elements may extend at least partly between two side wall sections 45B, 45C of the substantially hollow bar 4.

Here, the bar 4 has a substantially rectangular cross-section. Said cross-section can have a width W4 being larger then the height H4 of the bar, e.g. a width W4 being between 1.5 and 2.5 times wider than said height H4, preferably about 2 times wider. A relatively wide width, e.g. between 20 and 60 mm, preferably between 25 and 40 mm, such as for instance about 30 mm, can allow for relatively wide passages 6, and therefore for relatively thick and strong connecting elements 5, whereas a relatively small height H4 can facilitate that the grille 2 has a relatively small height H2 when its bars 4 are stacked in the collapsed state 2B of the grille 2.

However, in alternative embodiments, the cross-section may be formed differently. For example, the bars may have a relatively large height and/or a different shape, e.g. having a substantially square, circular or elliptical shape. It is noted that, for instance in case of a round or elliptical shaped cross-section, the side wall or side wall sections 45B, 45C of the bar 4 may substantially smoothly blend into the first and/or second wall section 45A, 45D, which may form an upper and/or a bottom wall section.

As shown in the exemplary embodiment of FIG. 3A, the bar 4 can comprise two parts 41, 42, preferably formed from a blank of sheet metal and/or bent sheet metal, especially bent steel sheets or bent steel plates. Although, the bar 4, such as the exemplary embodiment shown in FIG. 3A, may thus comprise two parts 41, 42, preferably both formed from bent sheet metal, the bar 4 may in alternative embodiments comprise more than two parts, e.g. three, four or five parts, or may alternatively comprise a single part. At least one of said one or multiple parts 41, 42 is formed from bent sheet metal, and one or more other parts of the bar 4 may be formed differently, for instance may be formed as a non-bent metal sheet part.

Advantageously, the metal sheet, especially a steel sheet, can be a purchase part and/or can have a standard thickness. The thickness of the steel sheet of which one or multiple parts can be formed can for instance be about 1 mm, 1.2, 1.5 mm, 2 mm, 2.5 mm, 3 mm or 4 mm, preferably about 2 mm.

Additionally or alternatively, the metal sheet, especially steel sheet, may be pre-galvanized, pre-coated or pre-painted.

Advantageously, the metal sheet, especially steel sheet, may be provided with a zinc-aluminum-magnesium coating, such as for instance the Magnelis® coating marketed by ArcelorMittal. The zinc-aluminum-magnesium coating can be an alloy comprising, and preferably substantially consisting of, zinc, aluminum and magnesium. For example, the alloy may comprise at least 1%, 1.5%, 2% or 2.5% magnesium, such as for instance about 3% magnesium, at least 1.5%, 2%, 2.5% or 3% aluminum, such as for instance about 3.5% aluminum, and/or at least 80%, 85%, 90% or 92% zinc, such as for instance about 93.5% zinc. For example, the zinc-aluminum-magnesium coating can be applied to the sheet by means of a continuous hot dip galvanizing process.

An advantage of the zinc-aluminum-magnesium coating, especially the Magnelis® coating, can lie in its self-repairing properties. For example, holes cut, especially punched or clipped or via another shearing technique, in a pre-coated sheet will have cut edges that can be protected by such coating. The coating, especially the Magnelis® coating, can protect exposed cut edges with a relatively thin zinc-based protective film with magnesium, which prevents corrosive reactions. As a result, it may be superfluous to treat, e.g. coat, the pre-coated sheet, in particular steel sheet, more in particular a steel sheet pre-coated with a zinc-aluminum-magnesium coating, especially a Magnelis® coating, after holes have been cut, especially punched, in said pre-coated sheet.

Advantageously, each of at least a number of the bars 4 of a security grille 2 can be put together from at least a first part 41 formed from a first blank of sheet metal and a second part 42 formed from a second blank of sheet metal. At least one said bar parts 41, 42, and preferably both, may be bent profile. The first part 41 can be at least partly enclosing the second part 42, and/or the first bar part 41 may define a hollow room 43 for accommodating the second part 42 at least partly in an assembled state of the bar 4. Advantageously, the second part 42 can be locked within the first part 41 in such manner that the second part 42 is substantially prevented from tilting or rotation about its central or longitudinal axis, e.g. letting the bar have a substantially rectangular cross-section. This may counteract jamming of the grille 2 and/or may counteract that the second 42, which can form an inner part 42, can unintentionally come loose from the first part 41 by falling there out, e.g. through a slit between two opposite supports 44A, 44B that can be provided at lower edges of the first bar part 41.

In embodiments, a bar part, especially the first bar part 41, may comprise one or multiple supports 44 or retaining elements 44. Said one or more supports 44 or retaining elements 44 may be for supporting a further bar part, especially the second part 42. Additionally or alternatively, said one or more supports 44 or retaining elements 44 may be for facilitating retaining said further bar part 42 at least partly within the bar part 41 provided with said one or more retaining elements 44 or supports 44.

Said supports 44 may for instance extend from a respective side wall section layer 41B, 41C in a substantially inward direction. For example, a first support 44A extending from a first side wall section layer 41B in a substantially inward direction can extend substantially toward a second support 44B that is extending from a second side wall section layer 41B in a substantially inward direction. Preferably, one or more supports 44 can be formed by bending or folding over parts of a blank. The supports 44 may for instance be formed by edges 44 of a profile 41 forming the respective bar part 41, especially the first bar part 41. Although the supports 44 are shaped as edges or strips, the supports may be formed differently. For example, one or both side wall section forming portions 41B, 41C of the first part 41 may be provided with one or multiple fingers for supporting the second part 42.

Figure 3B:
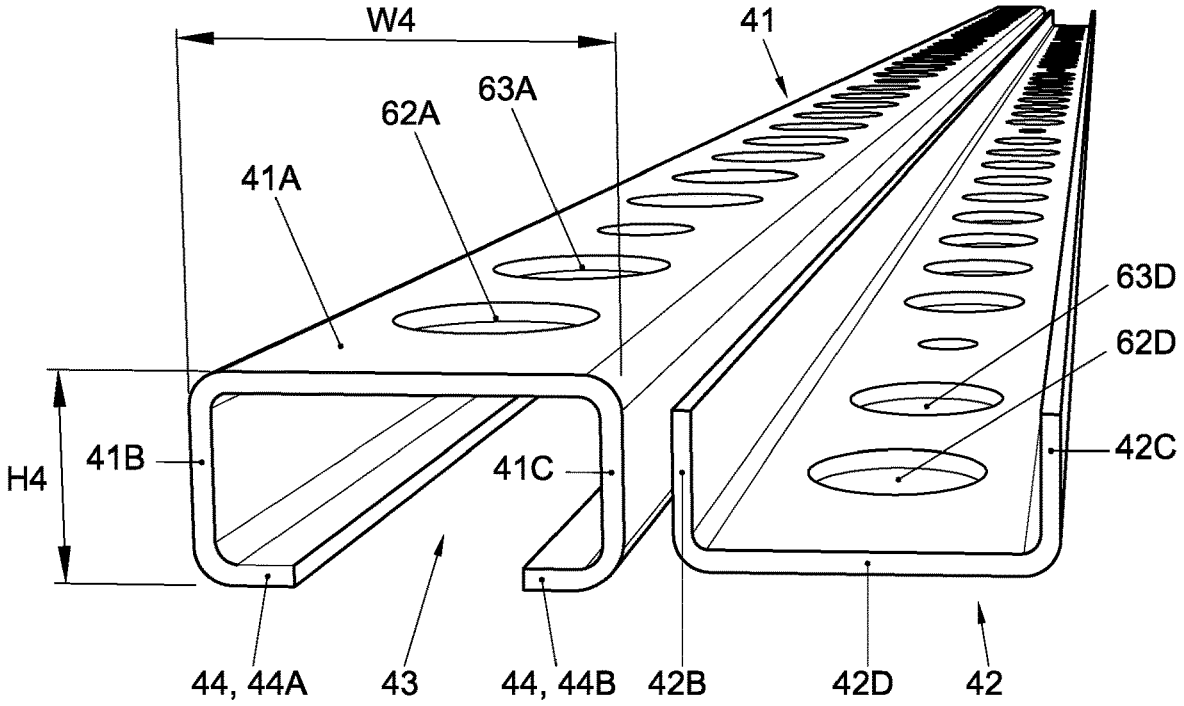
FIG. 3B shows a schematic perspective view of two bar parts of the bar of FIG. 3A.

As can be seen in FIG. 3B, the first bar part 41 can be bent such as to have a substantially C-shaped or U-shaped cross-section, especially formed as an inverted U having inwardly extending supports 44 at the ends of its "legs" 41B, 41C or strokes 41B, 41C. The second bar part 42, which then for instance can be formed such as to have a U-shaped cross section, can then be positioned at least partly into a hollow space 43 within the first part 41.

As can be seen in FIG. 3, at least one, and preferably both, of the side wall sections 45B, 45C of the bar 4 can comprise multiple layers 41B, 42B; 41C, 42C of sheet metal. Advantageously, one or both of said side wall sections 45B, 45C of the bar 4 can be put together from at least a first side wall section layer 41B; 41C formed by the first part 41 and at least a second side wall section layer 42B; 42C formed by the second part 42.

In embodiments, the first part 41 of the bar 4 can have a first wall section 41A being provided with a number of first holes 62A, 63A. Said first wall section 41A of the first part 41 may form at least a part of the first wall section 45A of the bar 4 or may alone form said first wall section 45A of the bar. The first part 41 can further have two side wall section layers 41B, 41C each forming a layer 41B, 41C of a respective side wall section 45B, 45C of the bar 4.

In embodiments, the first bar part 41 may thus comprise two interspaced side wall sections 41B, 41C, and said first wall section 41A can then form an intermediate wall section interconnecting said two side wall sections. Said side wall sections of the first part can form first side wall section layers of the substantially hollow bar.

Additionally or alternatively, the second part 42 of the bar 4 can comprise the second wall section 45D of the bar 4, or at least a layer 42D thereof. Further, the second part 42 may comprise two interspaced side wall sections 42B, 42C, and the second wall section layer 42D can then form an intermediate wall section 42D interconnecting said two side wall sections 42B, 42C. Said side wall sections 42B, 42C of the second part 42 can form second side wall section layers of the substantially hollow bar.

The side wall sections 41B, 41C of the first part 41 may cooperate with said side wall sections 42B, 42C of the second part 42 in order to form side wall sections 45B, 45C comprising multiple layers, i.e. at least two layers. Since the first part 41 may enclose the second part 42 at least partly, said first side wall sections 41B, 41C formed by the first part 41 may be located at outer sides of the second side wall sections 42B, 42C formed by the second part 42. As a result of the multiple layers 41B, 42B; 42B 42C, the side wall sections 45B, 45C of the bar 4 may be relatively thick, relatively stiff, and/or relatively strong.

It is noted that one or both of the first and second wall sections 45A, 45B of the bar 4 can be substantially formed by a single layer of sheet metal. In embodiments in which the bar 4 is composed from multiple bar parts 41, 42, especially multiple profiles 41, 42, the first bar part 41, especially formed as a first profile 41, may comprise the first wall section 45A. Additionally or alternatively, the second bar part 42, especially formed as a second profile 42, may comprise the second wall section 45D.

For example because upper and lower wall sections 45A, 45D of the bar may not need to be as stiff as side wall sections 45B, 45C of the bar 4, it can be an advantage that said upper and lower wall sections 45A, 45D can be relatively thin, e.g. being composed from relatively few layers, preferably comprising a single layer of sheet metal only. Hence, when a certain combined side wall section thickness, i.e. the combined thickness of the layers 41B, 42B; 41C, 42C of the respective side wall section 45B, 45C, is desired, material can be saved for the first and/or second wall sections 45A, 45D. In contrast to prior art bars from rectangular pipes, which have substantially equal wall thicknesses along their periphery, the bars made from bent sheet metal, e.g. composed from multiple bar parts, can have relatively strong, rigid and/or thick side walls or side wall sections, while having relatively thin and/or light top and/or bottom walls or wall sections. Economizing on material may not only save money due to limited use of material, but may also result in relatively light bars. Due to weight savings, an actuator for stacking and unstacking, i.e. extending, the grille 2 may be of a relatively light and/or cheap version.

Advantageously, the first part 41 and the second part 42 of the bar are not fixedly attached to each other, such that the second part 42 can be moved with respect to the first part 41 to some extent. For example, the second part 42 can be moved with respect to the first bar part 41 to at least a small extent in at least a direction substantially parallel with the longitudinal direction D2 of the bar 4. By not fixedly or completely rigidly attaching the first and second bar parts 41, 42 to each other, the bar 4 and/or the grille 2 can allow for some play, as a result of which can be counteracted that bars 4 may unintentionally get stuck, e.g. in or between bar guide 8A, 8B guiding the grille 2 when being extended or collapsed.

Alternatively, or additionally, in embodiments, the grille 2 or the grille system 1 can comprise one or multiple, especially two, elongated relatively rigid guiding elements 73, e.g. formed as a rod, rail, bar or tube, extending through multiple succeeding bars 4. As can be seen in FIG. 4, such elongated guiding elements 73 may preferably be located at or near a respective end portion 4', 4" of the bar 4. Preferably, the elongated guiding elements 73 may be located within a respective bar guide 8A, 8B, such that said elongated guiding elements 73, which do not retract during collapsing of the grille 2, will not block a part of the passage 3 when the grille 2 is in its collapsed state (see FIG. 1B).

Due to the one or multiple elongated guiding elements 73 extending through through holes through the bar parts 41, 42 of succeeding bars, 4 mutual movement of the bar parts 41, 42 of a bar 4, e.g. at least in their axial or longitudinal direction D2, can be limited or counteracted, which for instance can counteract jamming. An additional or alternative advantage of the guiding elements 73 may be that they can give extra firmness to the grille 2 or grille system 1. For example, in the extended state of the grille 2, the elongated guiding elements 73 can at least partly transmit forces exercised on one of the bars 4 to one multiple of the other bars. As a result, e.g. when one is tampering with one of the bars 4, the grille 2 may more or less act as a whole, for instance to counteract that one of the bars is levered or wrenched out of the respective bar guide 8A, 8B. For instance, a tampering force applied to a certain bar may be transferred to another bar and the multiple bars may transmit the initial tampering force over different regions of the bar guide(s), which may result in a relatively strong grille system 1.

Although the guiding elements 73 and the corresponding through holes in the bars 4 have a circular cross-section in the embodiment shown in FIG. 4, it will be appreciated that they may have alternative shapes, e.g. rectangular, oval, etc. in alternative embodiments.

It is noted that for the purpose of clarity and a concise description features are described herein as part of the same or separate embodiments, however, it will be appreciated that the scope of the invention may include embodiments having combinations of all or some of the features described.

Further, it is noted that the invention is not restricted to the embodiments described herein. It will be understood that many variants are possible.

For example, a first bar part and a second bar part do not need to have similar lengths. For example, a relatively long first bar part can hold multiple relatively short second bar parts.

Such and other variants will be apparent for the person skilled in the art and are considered to lie within the scope of the invention as formulated in the following claims.

The invention claimed is:

1. A collapsible security grille, comprising a multiplicity of successive bars that are configured to be stacked in a retracted state of the grille and are configured to be spaced apart with respect to each other in an extended state of the grille, and comprising a multiplicity of elongated connecting elements for interconnecting respective bars, wherein the bars of the multiplicity of successive bars extend parallel to each other and each of the bars of the multiplicity of successive bars extends horizontally and is provided with series of corresponding through holes or passages for receiving the elongated connecting elements, wherein at least a number of the bars comprises one or multiple parts formed from bent sheet metal, wherein each of the at least a number of the bars is formed as a hollow bar, wherein each of the at least a number of the bars is put together from at least a first part formed from a first blank of sheet metal and a second part formed from a second blank of sheet metal, wherein at least the first part is a bent profile, and/or wherein at least the second part is a bent profile and wherein the first part is at least partly enclosing the second part, and/or wherein the first part defines a hollow room for accommodating the second part at least partly in an assembled state of the bar, the first part comprising one or more multiple supports or retaining elements for supporting the second part and/or for facilitating the second part at least partly within the first part, the first part being configured to have a cross-section shaped as an inverted U, the one or more multiple supports or retaining elements being formed by inwardly extending supports at the ends of legs of the inverted U-shaped first part.

2. The grille according to claim 1, wherein each of the hollow bars has a first wall section facing towards an adjacent bar preceding said hollow bar and a second wall section facing towards a subsequent bar succeeding said hollow bar, the first wall section being provided with a number of first holes, the second wall section being provided with a number of corresponding second holes, wherein respective ones of the second holes form pairs with a respective one of the first holes, and wherein the pair of holes allows a respective one of the connecting elements to extend there through.

3. The grille according to claim 2, wherein each of the hollow bars further has at least two sections defining side walls, each of said two side wall defining sections extending from the first wall section towards the second wall section or vice versa.

4. The grille according to claim 3, wherein at least one of the side wall sections comprises multiple layers of sheet metal, and wherein at least one of said side wall sections are put together from at least a first side wall section layer formed by the first part and at least a second side wall section layer formed by the second part.

5. The grille according to claim 2, wherein the first wall section is formed by a portion of the first part formed from the first blank of sheet metal, and/or wherein the second wall section is formed by a portion of the second part formed from the second blank of sheet metal.

* * * * *